US012419449B1

(12) United States Patent
Elhart

(10) Patent No.: US 12,419,449 B1
(45) **Date of Patent: *Sep. 23, 2025**

(54) UNIVERSAL PILLOW FOR SIDE, BACK, AND STOMACH SLEEPERS

(71) Applicant: Nicholas S. Elhart, Zeeland, MI (US)

(72) Inventor: Nicholas S. Elhart, Zeeland, MI (US)

( * ) Notice: Subject to any disclaimer, the term of this patent is extended or adjusted under 35 U.S.C. 154(b) by 146 days.

This patent is subject to a terminal disclaimer.

(21) Appl. No.: 18/383,556

(22) Filed: Oct. 25, 2023

(51) Int. Cl.
*A47G 9/10* (2006.01)

(52) U.S. Cl.
CPC ..... *A47G 9/109* (2013.01); *A47G 9/1054* (2013.01); *A47G 2009/1018* (2013.01)

(58) Field of Classification Search
CPC .... A47C 17/045; A47C 27/001; A47G 9/109; A47G 9/10
See application file for complete search history.

(56) References Cited

U.S. PATENT DOCUMENTS 836,326 A * 11/1906 Kinyon ..... A47C 27/001 5/722
1,447,288 A * 3/1923 Emmerich ..... A47G 9/10 5/645
2,589,579 A * 3/1952 Slayen ..... A47C 27/001 5/722
2,738,834 A * 3/1956 Jaffe ..... A47G 9/10 5/420
2,877,472 A * 3/1959 Wagner ..... A47G 9/10 5/636
3,469,882 A * 9/1969 Laarsen ..... A47C 17/045 297/118
3,742,526 A * 7/1973 Lillard ..... A47C 17/045 5/28
3,757,365 A 9/1973 Kretchmer
4,231,127 A * 11/1980 Bendell ..... A47C 27/001 5/722
D261,681 S 11/1981 Chandler
4,752,064 A 6/1988 Voss
5,491,851 A * 2/1996 Alonso ..... A47C 27/001 5/722
5,987,676 A * 11/1999 Littleford ..... A47G 9/10 5/636
6,006,380 A 12/1999 Sramek
6,079,066 A 6/2000 Backlund
6,292,964 B1 9/2001 Rose et al.
6,951,035 B2 * 10/2005 Kinchen ..... A47G 33/00 5/655.9
7,150,057 B1 12/2006 Santiago et al.
(Continued)

FOREIGN PATENT DOCUMENTS

AT 412941 B * 8/2005 ..... A47C 17/045
KR 200346916 Y1 * 4/2004
KR 20120085565 A * 8/2012

*Primary Examiner* — Eric J Kurilla
(74) *Attorney, Agent, or Firm* — King & Partners, PLC

(57) ABSTRACT

A pillow for side, back, and stomach sleepers, including: (a) a first compartment; (b) a second compartment; (c) wherein the first and second compartments are associated with each other via a primary hinge and a secondary hinge; (d) wherein the pillow is readily convertible between an unfolded configuration and a folded configuration; and (e) wherein the unfolded configuration is adapted for back and stomach sleepers, and wherein the folded configuration is adapted for side-lying sleepers.

2 Claims, 14 Drawing Sheets

(56) References Cited

U.S. PATENT DOCUMENTS

| | | | | |
|---|---|---|---|---|
| 7,191,925 | B2 * | 3/2007 | Aris | A45C 9/00 224/582 |
| 7,516,504 | B2 | 4/2009 | Guez | |
| D645,693 | S | 9/2011 | Rothbard | |
| 8,566,985 | B2 | 10/2013 | Kim | |
| D731,816 | S | 6/2015 | Edgemon | |
| D778,086 | S | 2/2017 | O'Meara et al. | |
| D867,021 | S | 11/2019 | Yang | |
| D898,429 | S | 10/2020 | Huang | |
| 10,813,821 | B2 | 10/2020 | Marinkovic | |
| 11,596,247 | B2 | 3/2023 | Park | |
| 11,986,113 | B2 * | 5/2024 | Smith | B32B 3/08 |
| 12,251,039 | B2 * | 3/2025 | Davis | A47G 9/1045 |
| 2005/0138733 | A1 * | 6/2005 | Riesberg | A47G 9/10 5/636 |
| 2005/0223493 | A1 | 10/2005 | Setokawa et al. | |
| 2006/0290195 | A1 * | 12/2006 | Roleder | A61G 7/072 297/397 |
| 2008/0028529 | A1 * | 2/2008 | Abell | A47G 9/0253 5/636 |
| 2010/0017966 | A1 | 1/2010 | Cho | |
| 2016/0088951 | A1 * | 3/2016 | McGuinness | A47C 3/16 5/35 |
| 2018/0008064 | A1 * | 1/2018 | DuDonis | A47G 9/10 |
| 2021/0337991 | A1 | 11/2021 | Smith, Sr. | |

* cited by examiner

UNIVERSAL PILLOW FOR SIDE, BACK, AND STOMACH SLEEPERS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to pillows, and, more particularly, to pillows that are readily convertible between open (e.g., unfolded) and closed (e.g., folded) configurations/positions. The open position is preferably configured for back (i.e., supine) and stomach (i.e., prone) sleepers and the closed position is preferably configured for side-lying sleepers. The pillows of the present invention maximize comfort and minimize/eliminate shoulder and/or neck pain associated with the use of conventional pillows.

2. Background Art

Pillows have been known in the art for years and are the subject of a plurality of patents and publications, including: U.S. Pat. No. 11,596,247 entitled "Pillow for Healthy Ergonomic Positioning of the Neck and Spine," U.S. Pat. No. 10,813,821 entitled "Therapeutic Pillow," U.S. Pat. No. 8,566,985 entitled "Orthopedic Pillow for Sound Sleep," U.S. Pat. No. 7,516,504 entitled "Osteopathic Pillow," U.S. Pat. No. 7,150,057 entitled "Lower Leg and Foot Pillow," U.S. Pat. No. 6,292,964 entitled "Inclined Support Pillow," U.S. Pat. No. 4,752,064 entitled "Therapeutic Head Support," U.S. Pat. No. 3,757,365 entitled "Therapeutic Pillow," United States Patent Application Publication Number 2021/0337991 entitled "Neck and Back Pain Relieving Pillow," and United States Patent Application Publication Number 2005/0223493 entitled "Pillow"—all of which are hereby incorporated herein by reference in their entirety including all references cited therein.

U.S. Pat. No. 11,596,247 appears to disclose a pillow that includes a head support, a neck support, and an opening extending entirely through a central portion of the pillow. The head support includes a top surface and a bottom surface, and defines a first height extending between the top and bottom surfaces. The neck support is coupled to the head support and includes a top surface and a bottom surface. The top surface has a central portion and side portions. The central portion defines a second height extending between a base of the central portion and the bottom surface, and each of the side portions defines a third height extending between an apex of the respective side surface and the bottom surface. The third height is greater than the first and second heights.

U.S. Pat. No. 10,813,821 appears to disclose devices for neck support and correction, for example, pillows, headrests, or cushions, designed to be placed under the head and neck of a person lying in a supine or side-lying position. Such devices are useful for maintaining or improving cervical and/or thoracic spinal curvature and/or alignment and for reducing pain associated with ailments of the neck or cervical vertebrae. Also provided are methods of improving cervical spinal alignment and for treating or ameliorating ailments of the neck or cervical vertebrae.

U.S. Pat. No. 8,566,985 appears to disclose an orthopedic pillow for deep-sleep, preferably including: a pillow body to be horizontally put on a floor; a cervical vertebrae supporter having a transverse groove at a front center of the pillow body to slantly support the occipital bone and protruding upward to accommodate cervical vertebrae; an occipital base and upper cervical vertebrae supporter having a round-shape, longitudinal linear protruding groove placed at an inner end of the cervical vertebrae supporter transverse to the pillow body to support a user's upper cervical vertebrae; a back head-resting portion having a concave depression on a middle surface of a width and length structure of the pillow body in the occipital base and upper cervical vertebrae supporter; and a side head-resting portion having accommodating grooves symmetrically depressed from the back head-resting portion longitudinally from the pillow body to support a user's side head including the ear when a user lies on their side.

U.S. Pat. No. 7,516,504 appears to disclose a pillow that includes a body made of an elastically deformable material provided with a top side upon which the head of a user can be rested, and an underside for being placed upon a pillow support. The top side is joined to the underside by at least one shoulder side. The shoulder side is provided with a shoulder cut-out that forms an opening for the cervical vertebrae of the user when he is lying on his back, and forms an accommodating space for the shoulder of the user when he is lying on his side. The top side preferably comprises a recess that partially accommodates the head of the user, called the head receiving recess.

U.S. Pat. No. 7,150,057 appears to disclose a pillow approximately like the letter P in a prone position with a substantially flat or even top or upper surface that upwardly underlies the lower legs, beginning from the calves towards the heels, of the supine user to relieve stress or leg fatigue from long hours of work, shopping, standing or walking, to improve blood circulation and to help prevent varicose veins. It is made of spongy or resilient material, and covered by an inner overlay as a lining and a replaceable outer outlay as a pillowcase. It is intended for use at home, office or any room or place with adequate space.

U.S. Pat. No. 6,292,964 appears to disclose an inclined support pillow that includes a foam wedge and a resilient foam section substantially of the same length and width as a top surface of the foam wedge, with the bottom surface of the foam section attached to the top surface of the foam wedge. A covering of fabric or cloth is dimensioned for securement over the foam wedge and the foam section. At least two fastening strips are attached to the covering on a plane parallel to a top surface of the foam section. Two resilient cushions, each having a semi-circled top surface, a flat bottom surface and a covering of fabric or cloth, are provided with complementary fastening strips attached to the covering on a plane parallel to the flat bottom surface. The two cushions are aligned with the top surface of the foam section by press mating the complementary fastening strips to the fastening strips. The first of the cushions is relatively larger than the second cushion. The first cushion is to be used for lower back support and the second cushion for neck support. The fastening strips and complementary fastening strips may be made of Velcro-type material.

U.S. Pat. No. 4,752,064 appears to disclose a therapeutic device for supporting the head face down during an operation. The device is comprised of a pillow having a T-shaped void therein conforming to the contours of the face. One or more channels may be cut in the pillow to provide airways or allow insertion of a tube into the patient's mouth. A support structure is also described for use with the pillow. The support structure allows the patient's face to be seen, even while lying down, and consists of a plate attached to the end of a table by clamps, having a mirror below whose orientation may be adjusted.

U.S. Pat. No. 3,757,365 appears to disclose a pillow that is a flat substantially rectangular block of material that is more resilient on its upper top layer and is less resilient on its lowermost layer. It is substantially rectangular overall, but has a cutout in at least one of the longer rectangular sides, although this cutout may be repeated in the opposite rectangular side. The cutout is substantially circular, more or less, and is not greater than a semi-circle, although it may be somewhat less than a semi-circle, the cutout serving to receive the sleeper's shoulder with the attached arm extendable beyond the pillow and not subject to any pressure from the pillow, being entirely free thereof, and, of course, free of any pressure from the sleeper's head. The thickness of the pillow is such that the sleeper's head is supported in a horizontal position, with the neck and windpipe free of any bends. As a result, breathing is freer than with a conventional pillow, where the arm is often extended under the pillow attempting to hold the head horizontal, in which it often fails, but such does succeed in restricting the blood flow in the arm, leading to a condition strongly resembling bursitis in pain and restriction of arm movement, a painful condition not easily remedied.

United States Patent Application Publication Number 2021/0337991 appears to disclose a substantially planar therapeutic pillow assembly for a user and a method for using the same to relieve neck pain of the user. The pillow includes a fabric outer surface assembly circumscribing a compressible inner portion. Two compressible and substantially cylindrical foam tube assemblies are parallelly disposed within the compressible inner portion, the first substantially cylindrical foam tube assembly and the second substantially cylindrical foam tube assembly having differing pliability to optimally support the user's neck. A depressed portion of the compressible inner portion is laterally disposed between the first substantially cylindrical foam tube assembly and the second substantially cylindrical foam tube assembly and is designed to support the user's head.

United States Patent Application Publication Number 2005/0223493 appears to disclose a pillow that includes a main body having a concave portion in the central part, and a cold insulator mounted in the concave portion. This concave portion is open in the central part of the main body side wall on the side where the human nape is to be situated. The cold insulator has a film for inclusion, and a gel material which is internally included in the film for inclusion and which includes a crosslinked polymer that is not in a swelled state with a medium. It is preferred that the gel material includes an un-foamed polyurethane resin, and has an Asker F hardness of 10 or greater and 50 or less. Also, depth of the opening of the concave portion that is open at the main body side wall is preferably equal to or greater than one third of the height of this main body side wall. This pillow is constituted so that the head region can be held with a shape fitting the shape of the neck and head, therefore, any strain is not imposed to the body.

While the above-identified patents and publications do appear to disclose various pillows, their configurations remain non-desirous and/or problematic inasmuch as, among other things, none of the above-identified pillows appear to be readily convertible between unfolded and folded positions to accommodate side, back, and stomach sleepers toward maximizing comfort and minimizing/eliminating shoulder and/or neck pain associated with the use of conventional pillows.

These and other objects of the present invention will become apparent in light of the present specification, claims, and drawings.

SUMMARY OF THE INVENTION

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The present invention is directed to a universal pillow for side, back, and stomach sleepers, comprising, consisting essentially of and/or consisting of: (a) a first compartment; (b) a second compartment; (c) wherein the first and second compartments are associated with each other via a primary hinge and a secondary hinge; (d) wherein the pillow is readily convertible between an unfolded configuration and a folded configuration; and (e) wherein the unfolded configuration is adapted for back and stomach sleepers, and wherein the folded configuration is adapted for side-lying sleepers.

In a preferred embodiment of the present invention, the first compartment includes a first memory foam core that generally conforms to the shape of the first compartment.

In another preferred embodiment of the present invention, the second compartment includes a second memory foam core that generally conforms to the shape of the second compartment.

In yet another preferred embodiment of the present invention, the primary hinge comprises a fabric material that is secured to a bottom surface of the pillow when in the unfolded configuration (See FIG. 4) and is sandwiched between the first and second compartments when in the folded configuration (See FIG. 11).

In a preferred implementation of the present invention, the secondary hinge comprises a fabric material that is secured to a rear surface of the first component and a front surface of the second component when in the unfolded configuration (See FIGS. 4 and 6) and is secured to rear surfaces of the first and second components when in the folded configuration (See FIG. 11).

In another preferred implementation of the present invention, the secondary hinge comprises an elastomeric material to keep the pillow sufficiently taut in unfolded configuration.

In yet another preferred implementation of the present invention, the pillow includes means for maximizing comfort and minimizing shoulder and/or neck pain compared to the use of conventional pillows.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted.

It will be further understood that the invention is not necessarily limited to the particular embodiments illustrated herein.

Figure 1:
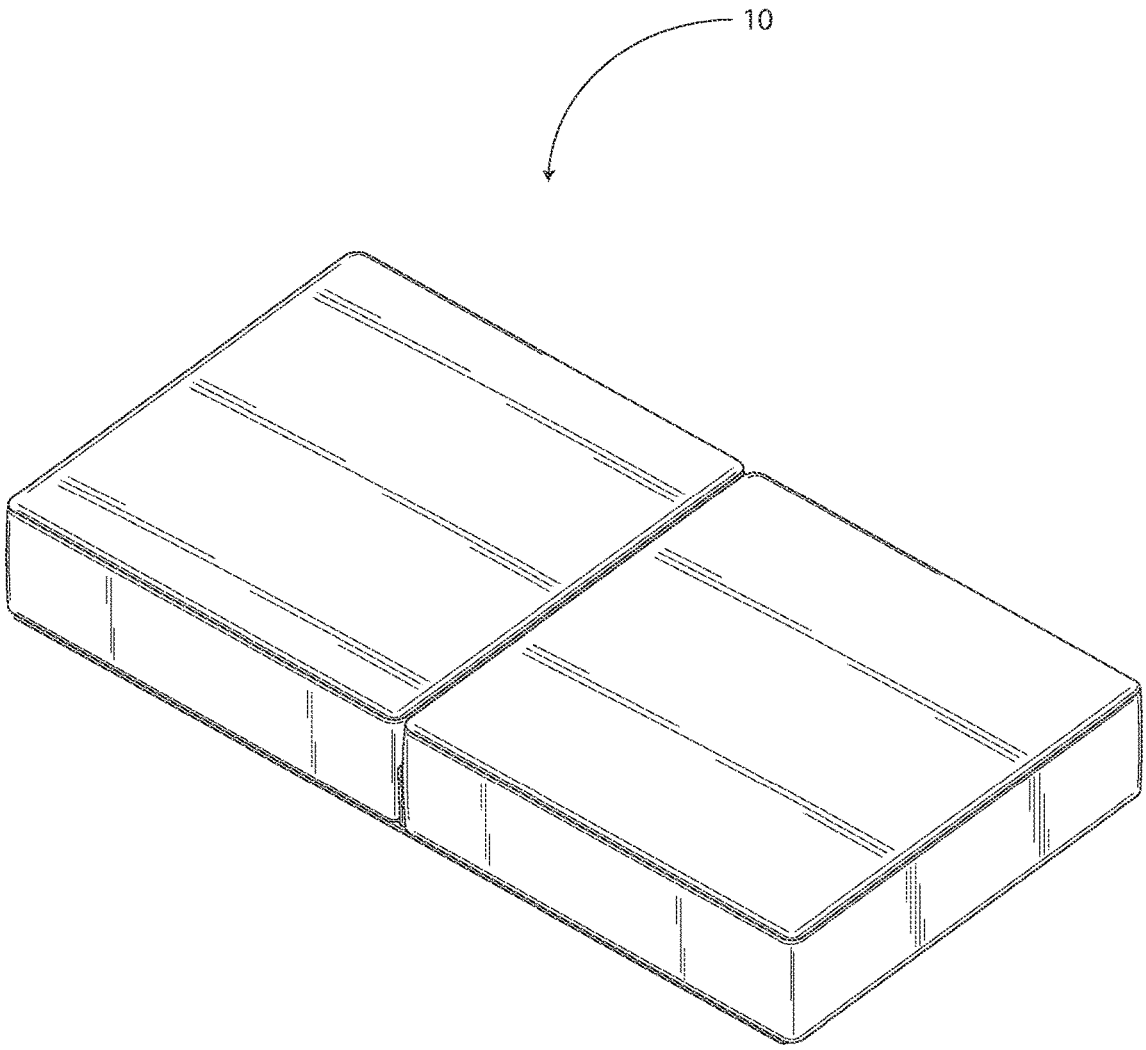
Figure 2:
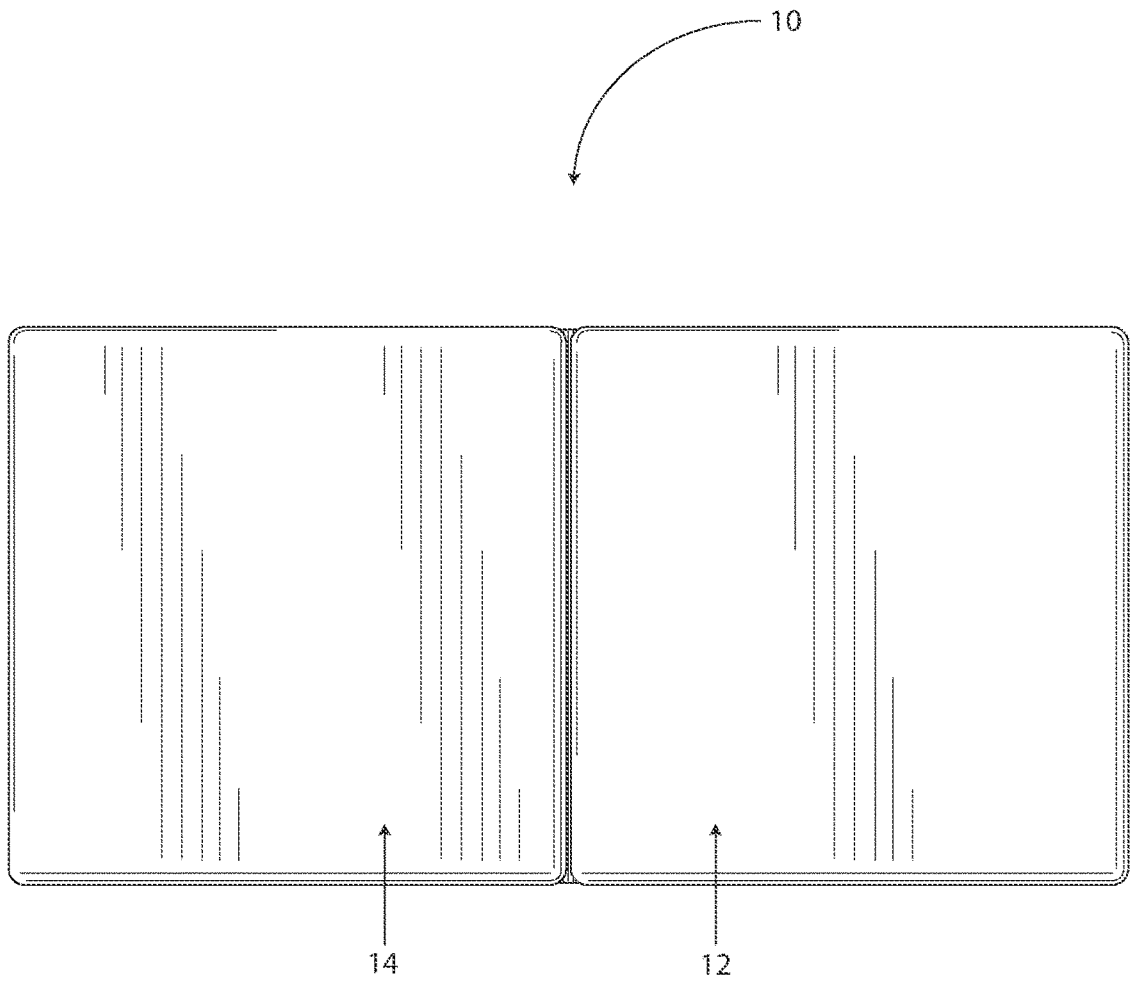
Figure 3:
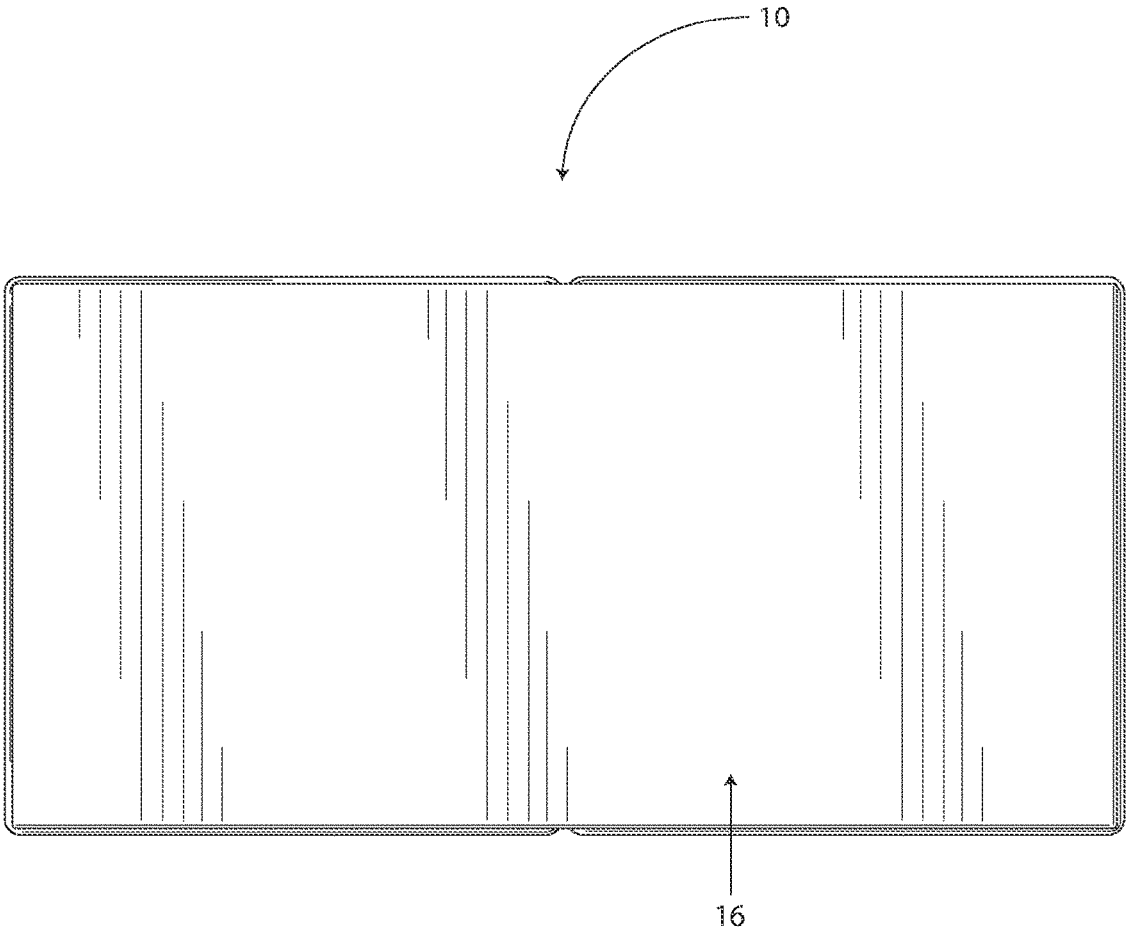
Figure 4:
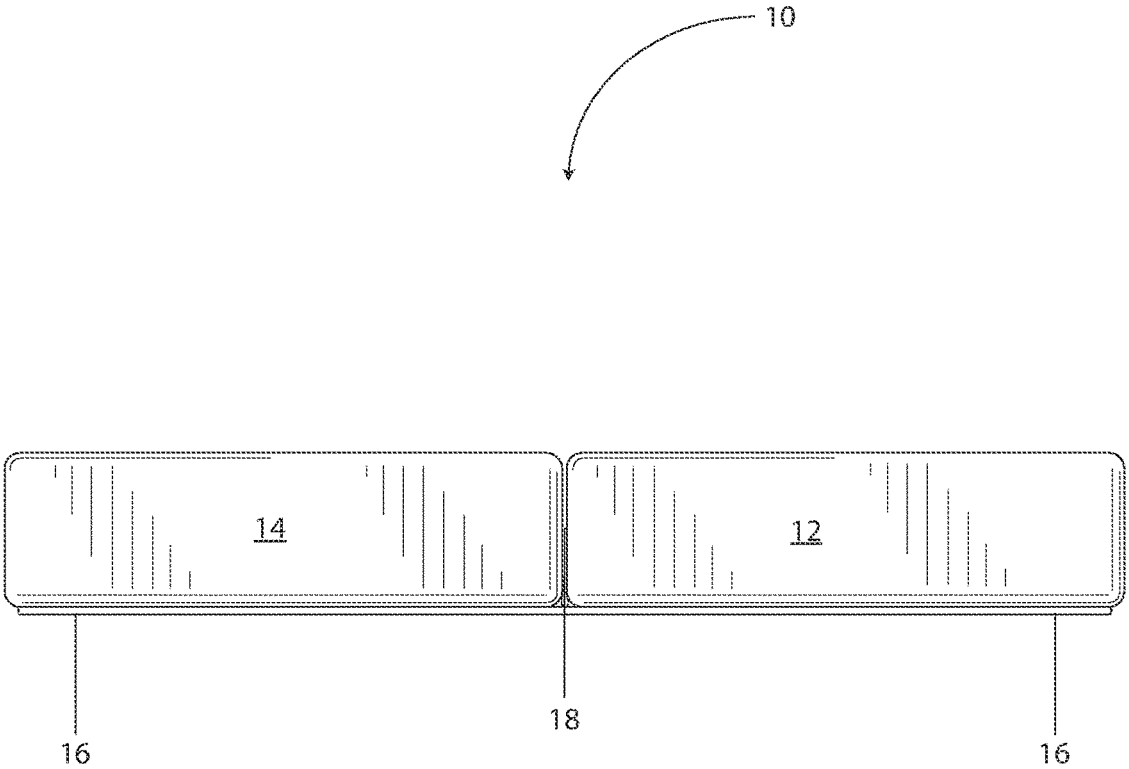
Figure 5:
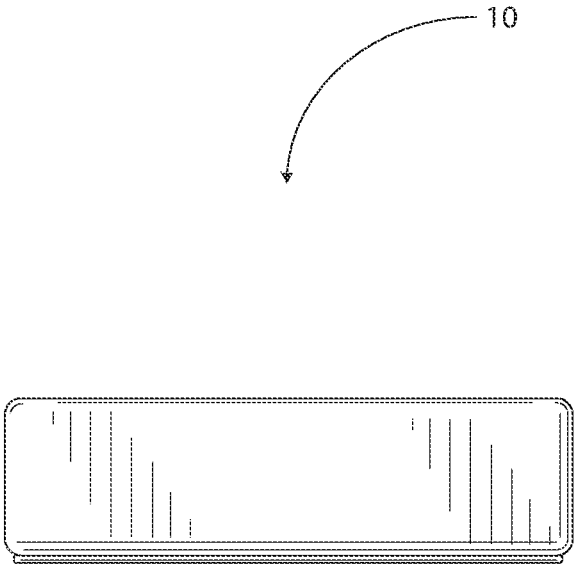
Figure 6:
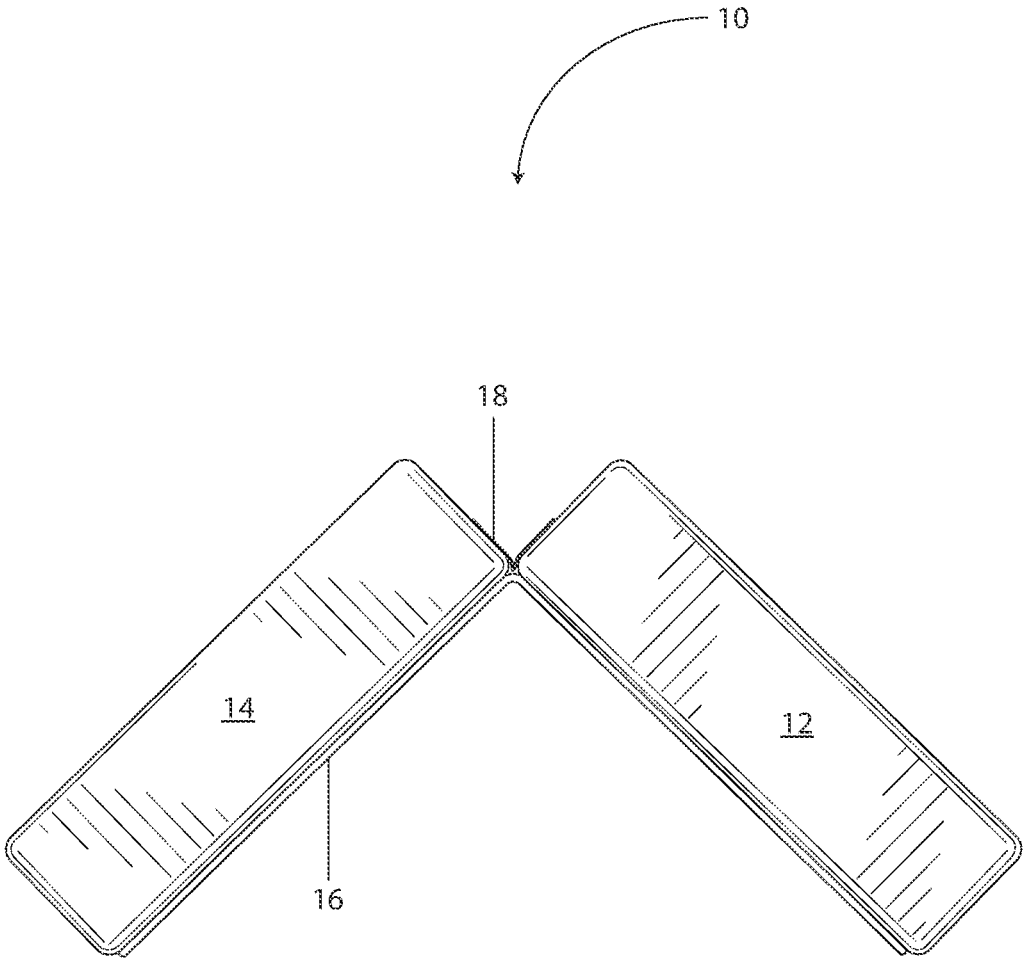
Figure 7:
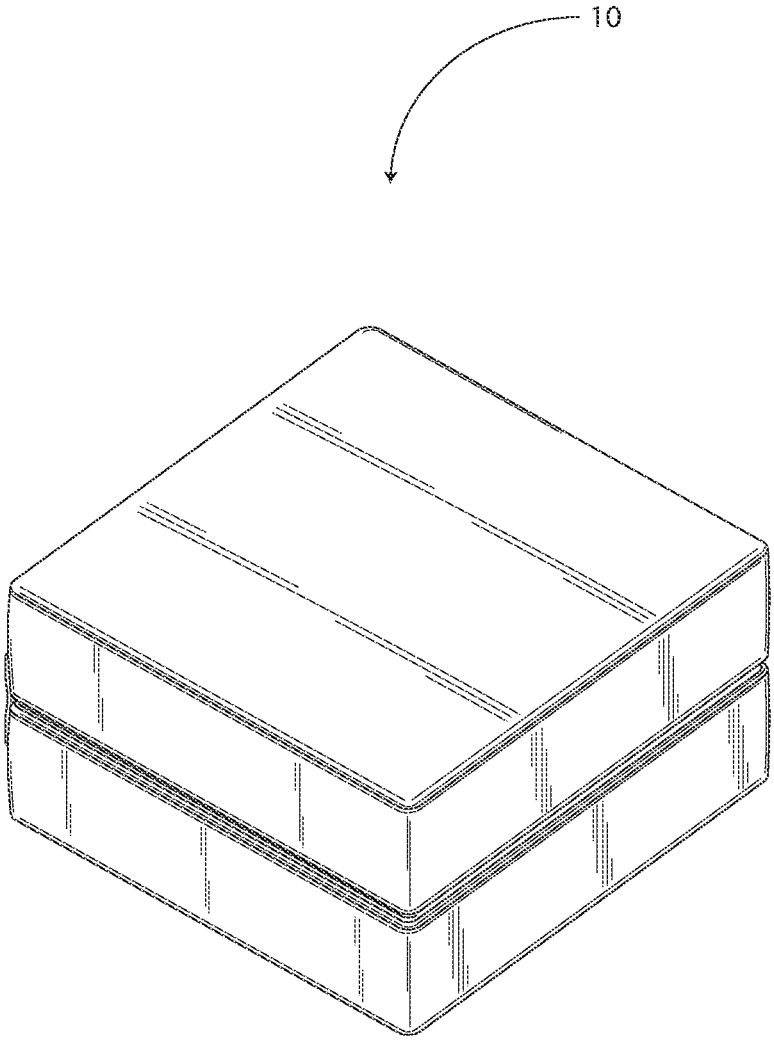
Figure 8:
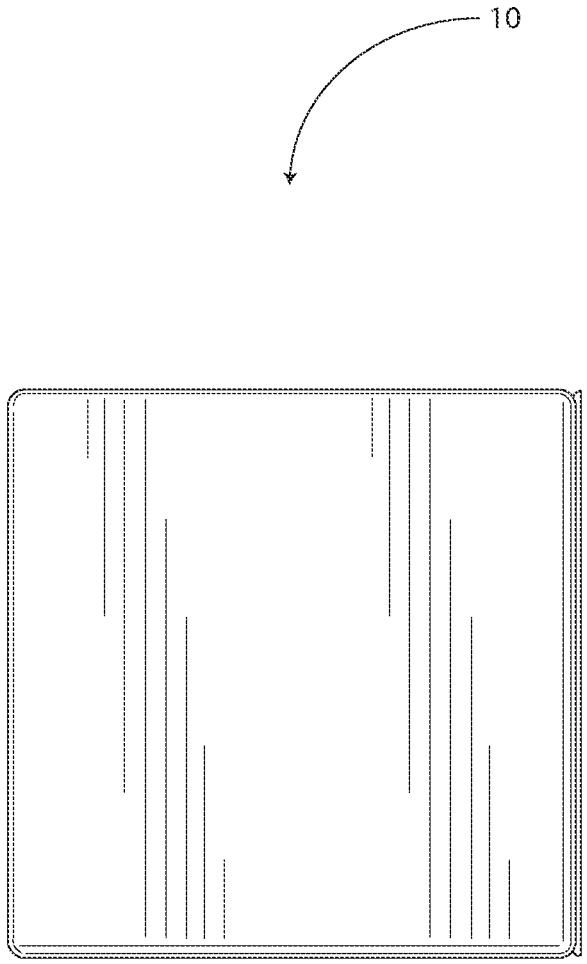
Figure 9:
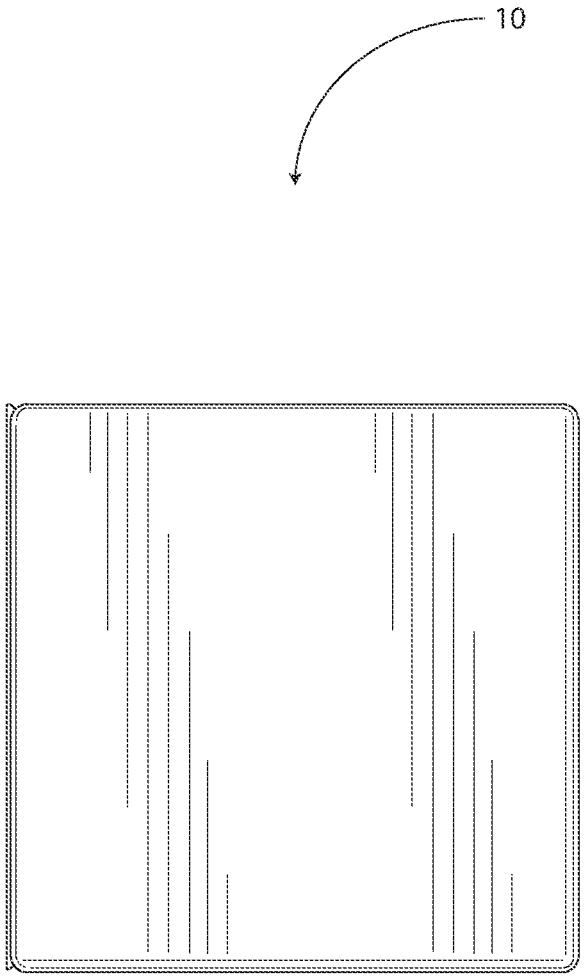
Figure 10:
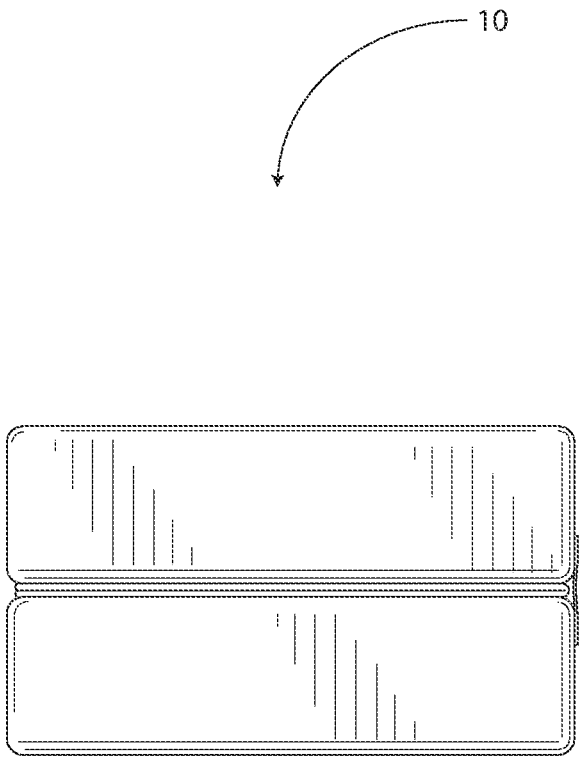
Figure 11:
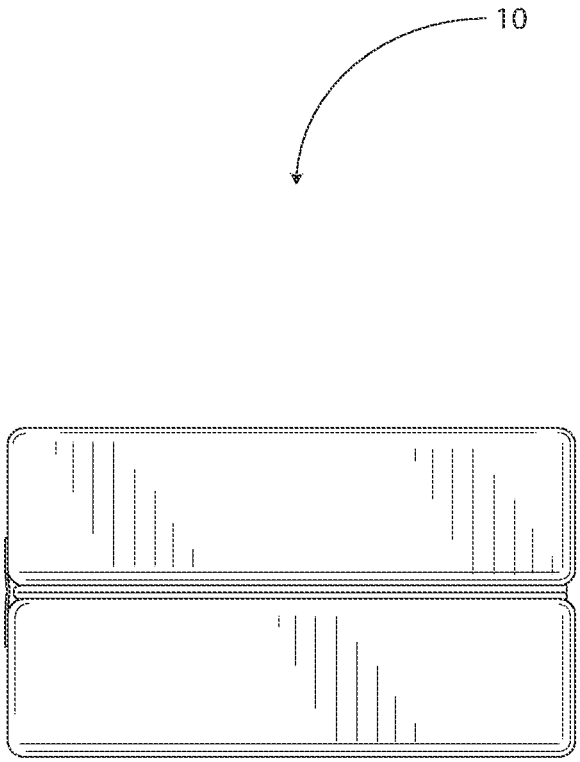
Figure 12:
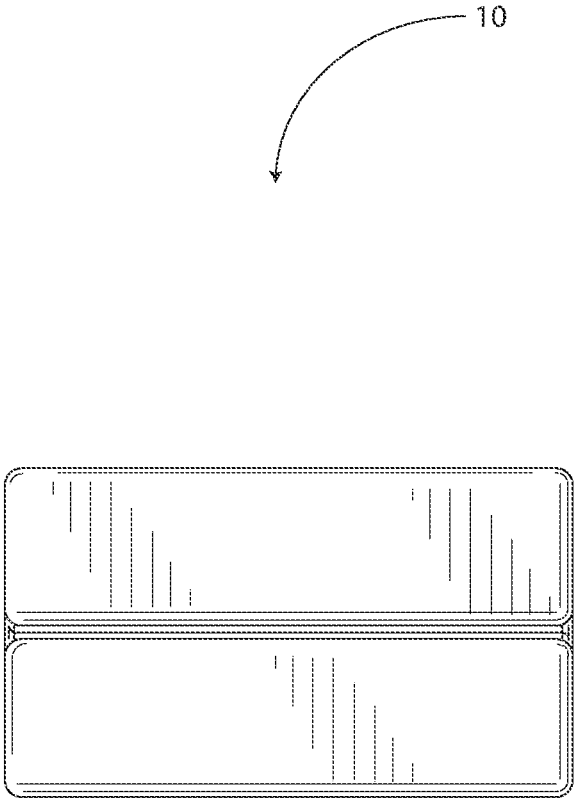

The invention will now be described with reference to the drawings wherein:

FIG. 1 is a perspective view of a pillow, fabricated in accordance with the present invention, shown in an open/unfolded configuration;

FIG. 2 is a top plan view of the pillow of FIG. 1;

FIG. 3 is a bottom plan view of the pillow of FIG. 1;

FIG. 4 is a right side elevation of the pillow of FIG. 1, and the left side elevation is a mirror image of the right side elevation;

FIG. 5 is a front side elevation of the pillow of FIG. 1, and the rear side elevation is a mirror image of the front side elevation;

FIG. 6 is a right side elevation of the pillow of FIG. 1 shown in a partially closed/folded configuration;

FIG. 7 is a perspective view of the pillow of FIG. 1 shown in a closed/folded configuration;

FIG. 8 is a top plan view of the pillow of FIG. 7;

FIG. 9 is a bottom plan view of the pillow of FIG. 7;

FIG. 10 is a right side elevation of the pillow of FIG. 7;

FIG. 11 is a left side elevation of the pillow of FIG. 7;

FIG. 12 is a front side elevation of the pillow of FIG. 7.

Figure 13:
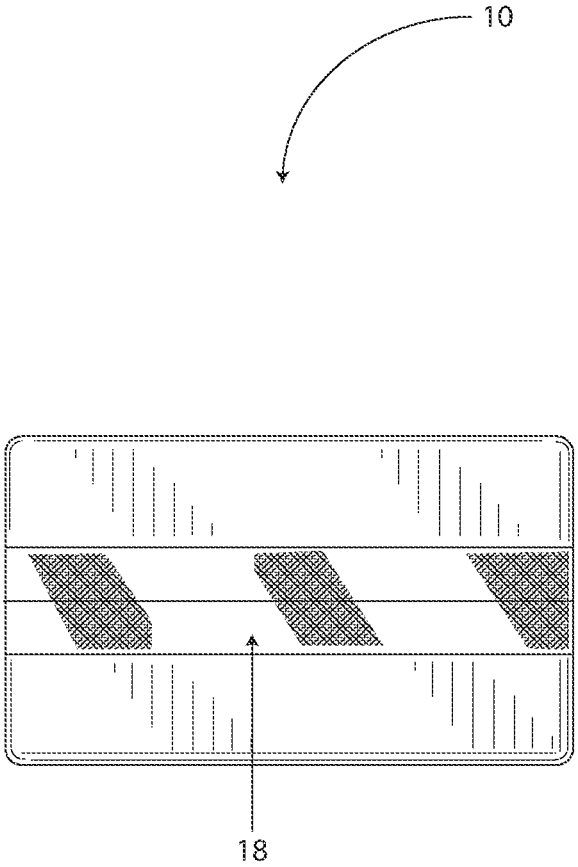

FIG. 13 is a rear side elevation of the pillow of FIG. 7; and

Figure 14:
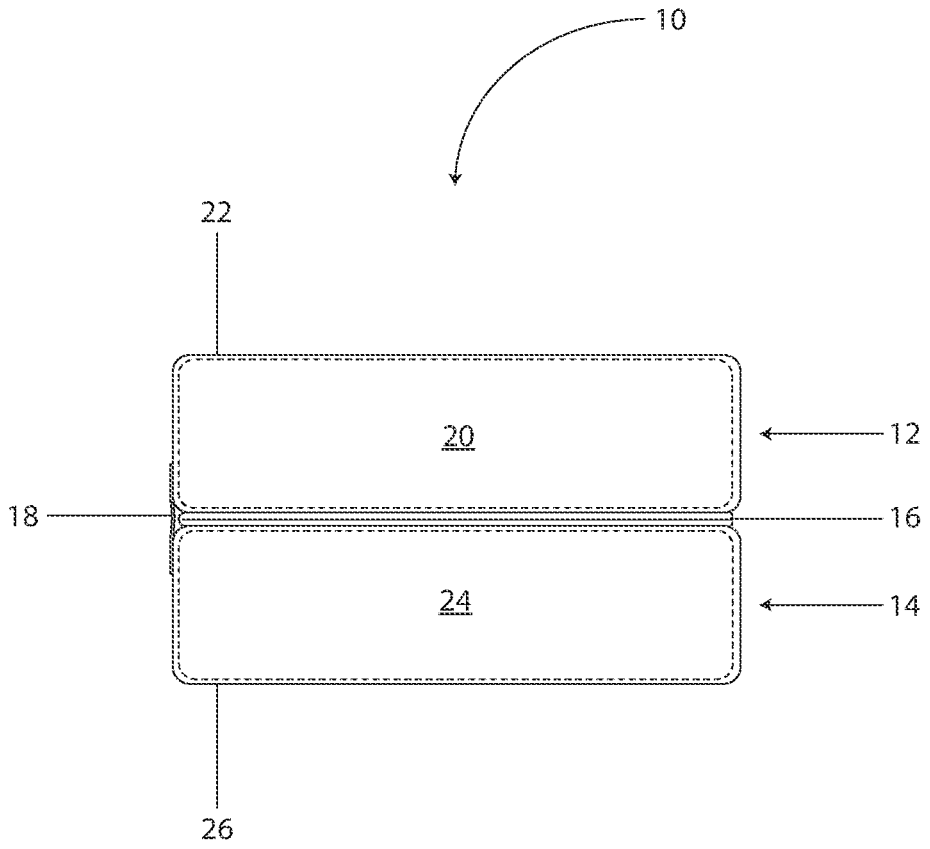

FIG. 14 is a left side elevation of the pillow of FIG. 7 shown with the left side outer liner in phantom (i.e., transparent) to emphasize the inner core/memory foam components.

DETAILED DESCRIPTION OF THE INVENTION

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

Referring now to the collective drawings, and to FIGS. 1-14 in particular, pillow 10 is shown as generally comprising first compartment 12, second compartment 14, primary hinge/connector 16, and secondary hinge/connector 18. In accordance with the present invention, pillow 10 is readily convertible between an unfolded/open configuration and a folded/closed configuration. The unfolded configuration is adapted to accommodate back and stomach sleepers, and the folded configuration is adapted to accommodate side-lying sleepers. Collectively, the unfolded and folded configurations enable maximum comfort for the sleeper in any position (e.g., prone, supine, side-lying) while, at the same time, minimizes/eliminates shoulder and/or neck pain compared to the use of conventional pillows. The term conventional pillow is intended to mean a standard single compartment pillow with a traditional rectangular pillowcase.

As is best shown in FIG. 14, pillow 10 preferably includes first compartment 12 that includes first memory foam core 20 positioned within outer liner 22, and second compartment 14 that includes second memory foam core 24 positioned within outer liner 26. Although not shown, it will be understood that the memory foam cores are inserted into each compartment via a slot/opening made available via, for example, a zipper, one or more buttons, one or more snaps, a hook and loop fastener—just to name a few.

Moreover, the memory cores of the present invention, may be partially and/or fully substituted with, for example, down feather, a plurality of polyurethane foam pieces, polystyrene pellets, etcetera.

As is best shown in FIGS. 4 and 11, primary hinge 16 of pillow 10 preferably includes a material (e.g., a fabric, an elastomeric strip, a rubber strip, a flexible, frameless material, a rubber strip, etcetera) secured (e.g., sewn, stitched, snapped, glued, riveted, etcetera) to a bottom surface of the pillow when in the unfolded configuration and sandwiched between the first and second compartments when in the folded configuration.

As is further shown in FIGS. 4, 6, and 11, secondary hinge 18 of pillow 10 preferably includes a material secured to a rear surface of the first component and a front surface of the second component when in the unfolded configuration and rear surfaces of the first and second components when in the folded configuration.

In one embodiment of the present invention, the secondary hinge comprises a thermoplastic elastomer, such as a styrenic block copolymer, a thermoplastic olefin, an elastomeric alloy, a thermoplastic polyurethane, a thermoplastic copolyester, and/or a thermoplastic polyamide.

In another aspect of the invention, the secondary hinge comprises a natural polyisoprene, a synthetic polyisoprene, a polybutadiene, a chloroprene rubber, a butyl rubber, a halogenated butyl rubber, a styrene-butadiene rubber, a nitrile rubber, a hydrogenated nitrile rubber, an ethylene propylene rubber, an ethylene propylene diene rubber, an epichlorohydrin rubber, a polyacrylic rubber, a silicone rubber, a fluorosilicone rubber, a fluoroelastomer, a perfluoroelastomer, a polyether block amide, a chlorosulfonated, ethylene-vinyl acetate, a resilin, an elastin, a polysulfide rubber, and/or an elastolefin.

In yet another preferred embodiment of the present invention, the secondary hinge comprises a composite of polyvinyl chloride and a plasticizer. In this embodiment, the plasticizer preferably comprises a bio-based plasticizer, a dicarboxylic/tricarboxylic ester-based plasticizer, a trimellitate, an adipate, a sebacate, a maleate, an azelate, a benzoate, a terephthalates, 1,2-cyclohexane dicarboxylic acid diisononyl ester, an alkyl sulphonic acid phenyl ester, a sulfonamide, an organophosphate, a tricresyl phosphate, a tributyl phosphate, a glycol, a polyether, a triethylene glycol dihexanoate, a tetraethylene glycol diheptanoate, a polymeric plasticizer, and/or a polybutene.

In one preferred implementation of the present invention, the secondary hinge comprises a bio-based plasticizer, such as acetyl tributyl citrate, trioctyl citrate, acetyl trioctyl citrate, trihexyl citrate, acetyl trihexyl citrate, butyryl trihexyl citrate, and/or trimethyl citrate.

In accordance with the present invention, the outer liner(s) of the present invention may comprise any one of a number of materials, such as natural and/or synthetic fibers/materials—including, but not limited to cotton, wool, linen, silk, cashmere, hemp, jute, elastane, nylon, modacrylic, olefin, acrylic, polyester, rayon, vinyon, saran, spandex, vinalon, aramids (e.g., nomex, kevlar, twaron, etcetera), modal, dyneema/spectra, polybenzimidazole fiber, sulfar, lyocell, orlon, zylon, vectran, and/or derclon—just to name a few.

The foregoing description merely explains and illustrates the invention and the invention is not limited thereto except insofar as the appended claims are so limited, as those skilled in the art who have the disclosure before them will be able to make modifications without departing from the scope of the invention.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etcetera shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etcetera. As a non-limiting example, each range discussed herein can be readily broken down into a lower third, middle third and upper third, etcetera. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed and desired to be secured by Letters Patent of the United States is:

1. A pillow for side, back, and stomach sleepers, consisting of:

a first compartment, wherein a memory core is positioned within the first compartment;

a second compartment, wherein a memory core is positioned within the second compartment;

wherein the first and second compartments are associated with each other via a primary hinge and a secondary hinge, and wherein the secondary hinge is elastomeric;

wherein the pillow is readily convertible between an unfolded configuration and a folded configuration; and wherein the unfolded configuration is adapted for back and stomach sleepers, and wherein the folded configuration is adapted for side-lying sleepers.

2. A pillow for side, back, and stomach sleepers, consisting of:

a first compartment having a rectangular prism shape with a top surface, a bottom surface, a front surface, a rear surface, and opposing side surfaces, wherein the first compartment includes a first memory foam core, wherein the first memory foam core generally conforms to the shape of the first compartment, and wherein the first memory foam core is positioned within a first outer liner, the first outer liner comprising a fabric material selected from the group consisting of cotton, wool, linen, silk, cashmere, hemp, jute, elastane, nylon, modacrylic, olefin, acrylic, polyester, rayon, and combinations thereof, and wherein the first outer liner includes an opening for inserting and removing the first memory foam core, the opening being closeable with a closure device selected from the group consisting of a zipper, one or more buttons, one or more snaps, and a hook and loop fastener;

a second compartment having a rectangular prism shape with a top surface, a bottom surface, a front surface, a rear surface, and opposing side surfaces, wherein the second compartment includes a second memory foam core, wherein the second memory foam core generally conforms to the shape of the second compartment, and wherein the second memory foam core is positioned within a second outer liner, the second outer liner comprising a fabric material selected from the group consisting of cotton, wool, linen, silk, cashmere, hemp, jute, elastane, nylon, modacrylic, olefin, acrylic, polyester, rayon, and combinations thereof, and wherein the second outer liner includes an opening for inserting and removing the second memory foam core, the opening being closeable with a closure device selected from the group consisting of a zipper, one or more buttons, one or more snaps, and a hook and loop fastener;

a primary hinge comprising a fabric material secured specifically to a bottom surface of the first compartment and a bottom surface of the second compartment when the pillow is in an unfolded configuration, and wherein the primary hinge is sandwiched between the first and second compartments when the pillow is in a folded configuration, the primary hinge being secured to the first and second compartments by a method selected from the group consisting of sewing, stitching, snapping, gluing, and riveting;

a secondary hinge comprising an elastomeric material, wherein the elastomeric material is a thermoplastic elastomer selected from the group consisting of a styrenic block copolymer, a thermoplastic olefin, an elastomeric alloy, a thermoplastic polyurethane, a thermoplastic copolyester, and a thermoplastic polyamide, and wherein the secondary hinge is secured to a rear surface of the first compartment and a front surface of the second compartment when the pillow is in the unfolded configuration, and is secured to rear surfaces of both the first and second compartments when the pillow is in the folded configuration, the secondary hinge being secured to the first and second compartments by a method selected from the group consisting of sewing, stitching, snapping, gluing, and riveting, and wherein the secondary hinge provides sufficient elasticity to keep the pillow taut in the unfolded configuration;

wherein the pillow is manually convertible between the unfolded configuration and the folded configuration;

wherein in the unfolded configuration, the first compartment and the second compartment are substantially coplanar, the primary hinge is extended flatly across a bottom surface of the pillow connecting the bottom surfaces of the first and second compartments, and the secondary hinge extends across a junction between the rear surface of the first compartment and the front surface of the second compartment;

wherein in the folded configuration, the first compartment and the second compartment are substantially parallel to one another with their respective bottom surfaces facing each other, the primary hinge is compressed in a folded position sandwiched between the bottom surfaces of the first and second compartments, and the secondary hinge wraps around the rear surfaces of both the first and second compartments;

wherein the unfolded configuration provides a substantially flat and elongated sleeping surface adapted for back and stomach sleepers by distributing support across a larger surface area; and wherein the folded configuration provides an elevated and thickened sleeping surface adapted specifically for side-lying sleepers by providing increased thickness to accommodate shoulder width and maintain proper spinal alignment of a side-lying sleeper.

* * * * *